United States Patent [19]

Anderson

[11] Patent Number: 4,537,358

[45] Date of Patent: Aug. 27, 1985

[54] NOZZLE FOR WATER TUB

[75] Inventor: George F. Anderson, Mountaintop, Pa.

[73] Assignee: U.S. Leisure Incorporated, Incline Village, Nev.

[21] Appl. No.: 423,769

[22] Filed: Sep. 27, 1982

[51] Int. Cl.[3] ..... B05B 7/02

[52] U.S. Cl. ..... 239/413; 239/428.5; 239/579; 239/582

[58] Field of Search ..... 239/401, 407, 413, 428.5, 239/577, 579, 580, 581, 582

[56] References Cited

U.S. PATENT DOCUMENTS

| | | | |
|---|---|---|---|
| 2,888,979 | 6/1959 | Lindgren | 239/572 |
| 3,116,880 | 1/1964 | Kuiken | 239/581 |
| 3,341,132 | 9/1967 | Parkison | 239/428.5 |
| 3,471,091 | 10/1969 | Baker | 239/428.5 |
| 3,648,932 | 3/1972 | Ewald et al. | 239/428.5 |
| 4,189,099 | 2/1980 | Bruninga | 239/582 |

*Primary Examiner*—Andres Kashnikow

*Attorney, Agent, or Firm*—Townsend & Townsend

[57] ABSTRACT

An improved nozzle for use with a tub, such as a redwood tub, having a side wall provided with an opening therethrough. The nozzle comprises a nozzle body receivable in the wall opening and having a main water-receiving bore therethrough. A flow control valve is in the main bore and is manually adjustable at the outlet end of the main bore. The nozzle body has a secondary bore provided with a one-way check valve therein. The secondary bore communicates with the main bore to allow air to pass into the water by suction to aerate the water as it flows into the tub. A flow regulator member is adjustably mounted on the nozzle body near the outlet end of the main bore for controlling the flow of air into the water flow. Several embodiments of the check valve are disclosed.

9 Claims, 9 Drawing Figures

NOZZLE FOR WATER TUB

FIELD OF THE INVENTION

This invention relates to flow control nozzles of the type used in hot tubs and the like and, more particularly, to an improved nozzle having an integral body provided with water aeration means carried by the nozzle body.

BACKGROUND OF THE INVENTION

In conventional water nozzles for hot tubs and the like, air flow to such a nozzle to aerate the water flowing therethrough requires complex structure and necessitates changes to the tub after the nozzle has been mounted in place on the tub. In the case of redwood tubs, the tub wood must be routed to provide air hose extensions to the nozzle. Also, it is generally necessary to provide an air inlet orifice grill at the top of the tub and this grill could present problems if the tub is surrounded by a deck. In the case of vinyl tubs, the tub liner must be cut in a number of places thus requiring seals which present leakage problems. Also, the conventional nozzles are separate from the air delivery structures coupled therewith so that seal problems arise which increase production costs and affect the operating efficiency of the nozzles. Because of these drawbacks, a need has arisen for improvements in a nozzle for tubs of this type.

SUMMARY OF THE INVENTION

The present invention fills the aforesaid need by providing a nozzle which is formed from a composite nozzle body having a main bore therethrough for water flow and a second bore adjacent to the main bore for air flow. The second bore has a check valve therein responsive to a suction force due to the water flow through the main bore. Thus, air can flow into the main bore to aerate the water yet the nozzle itself is highly efficient, is inexpensive to produce and maintain, and can be readily assembled to a tub.

The nozzle of the present invention eliminates the need to route the wood of a redwood tub for air hose extensions as required with conventional nozzles. The nozzle also eliminates the need for an air inlet orifice grill at the top of the tub which could otherwise be complicated by a deck surrounding the upper part of the tub. The nozzle further eliminates the need to cut a vinyl tub liner in a number of places to accommodate aerating structure.

Among the advantages of the nozzle of the present invention is that it provides a relatively short air flow passage that reduces the static pressure drop in the nozzle body itself. The construction nozzle of the nozzle body unitizes the nozzle itself and permits the servicing of the air valve without removing the nozzle body from the tub.

The nozzle will not rotate relative to the tub during assembly and will not damage or wrinkle a liner used with the tub. Moreover, the nozzle will provide a better water seal than is available with conventional nozzles. The water flow and the air flow through the nozzle can be metered at various rates or completely shut off, if desired.

The primary object of the present invention is to provide an improved water nozzle for a water tub wherein the nozzle is of unitary construction, has a check valve for air flow into the nozzle for aeration purposes, and the air flow passage is built into the nozzle body and is of relatively short length to minimize static drop yet the nozzle is simple and rugged in construction, relatively inexpensive to produce and maintain, and is easy to assembly to a tub at the side wall thereof.

Other objects of this invention will become apparent as the following specification progresses, reference being had to the accompanying drawings for an illustration of the invention.

Figure 1:
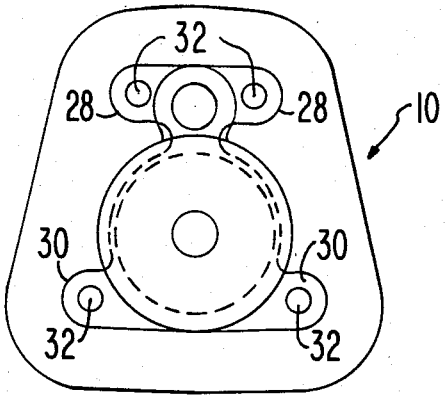
FIG. 1 is a rear-elevational view of the improved nozzle of the present invention.
Figure 2:
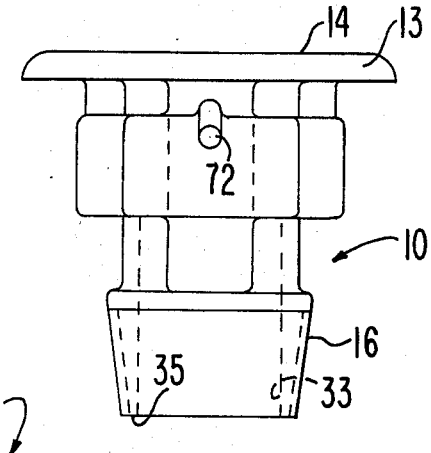
FIG. 2 is a top plan view of the nozzle showing a check valve and a flow regulating member therefor.
Figure 3:
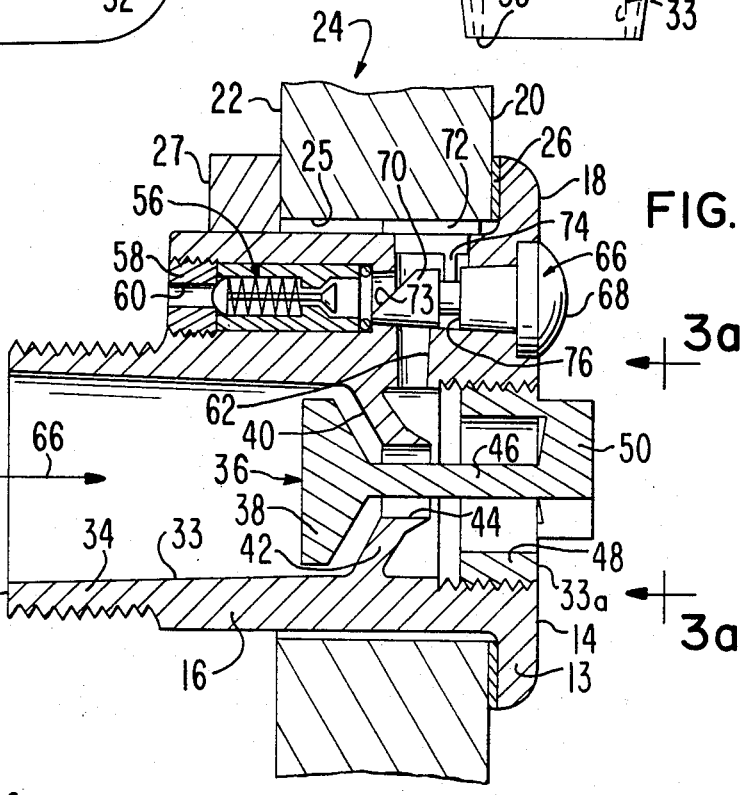
FIG. 3 is a vertical section through the nozzle showing a check valve and a flow regulating member therefor.
Figure 3A:
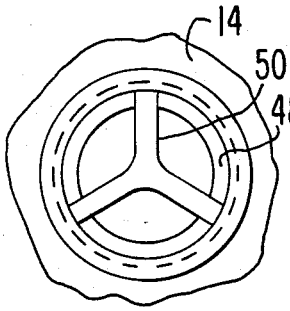
Figure 4:
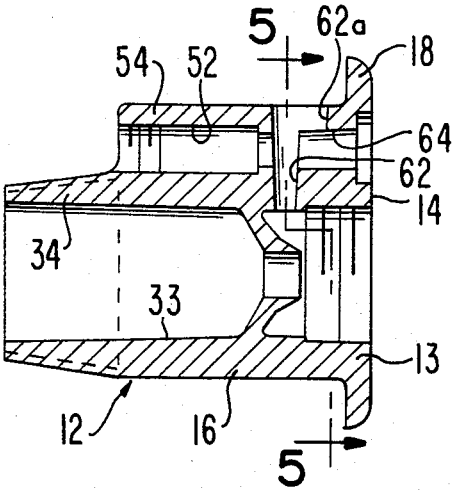
Figure 5:
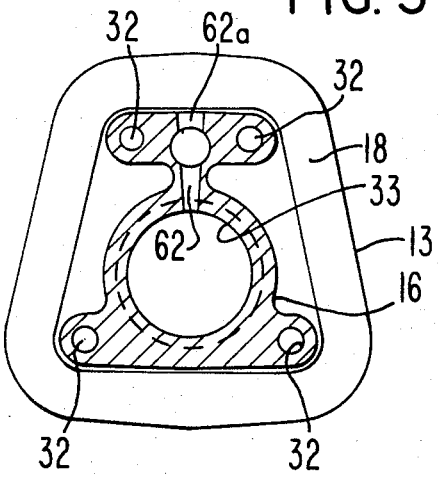

FIG. 3*a* is a fragmentary, front elevational view of the nozzle, looking in the direction of line 3*a*—3*a* of FIG. 3;

FIG. 4 is a view similar to FIG. 3 but showing only the nozzle body without the check valve therein or the flow regulating member thereof;

FIG. 5 is a vertical section taken along 5—5 of FIG. 4; and

Figure 6A:
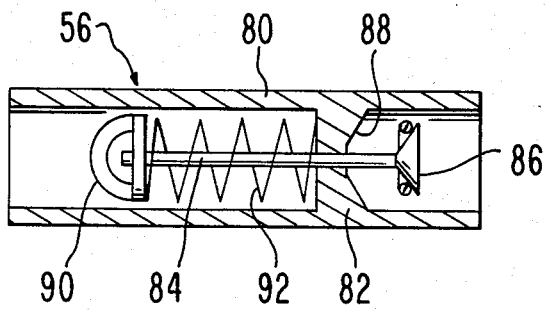
Figure 6B:
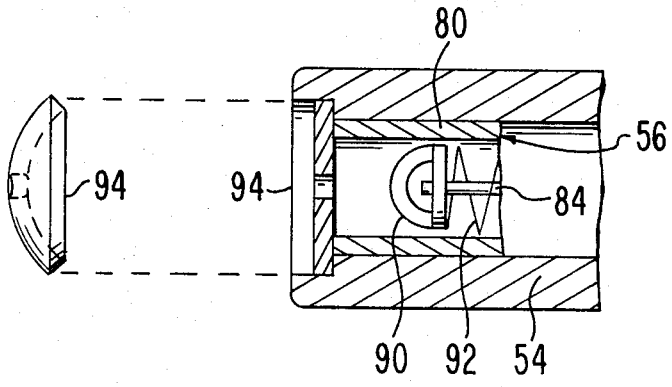
Figure 6C:
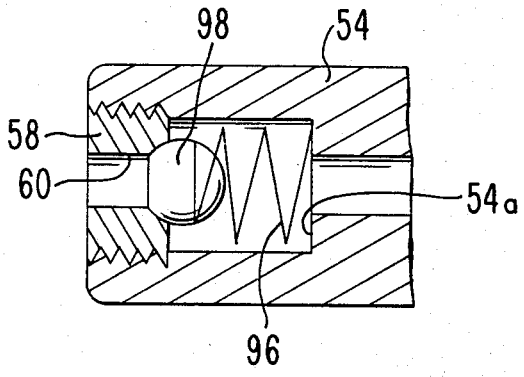

FIGS. 6*a*, 6*b* and 6*c* are cross-sectional views showing several embodiments of the check valve.

The nozzle of the present invention is broadly denoted by the numeral 10 and includes a body 12 as shown in FIG. 4. Body 12 has front plate 13 provided with a generally flat face 14. A generally cylindrical member 16 is integral with front plate 13 and projects rearwardly therefrom. The outer periphery of front plate 13 presents a generally continuous flange 18 (FIGS. 3–5) which is adapted to be placed adjacent to the inner surface 20 of the outer wall 22 of a tub 24 having a hole 25 through wall 22 for receiving nozzle body 12 as shown in FIG. 3. A seal 26 typically is between flange 18 and surface 20 when the nozzle is in place in the operative position shown in FIG. 3.

A bracket 27 is removably coupled to body 12 of nozzle 10 to releasably hold nozzle 10 in coupled relationship to wall 22. For purposes of illustration, nozzle body 12 has an upper boss 28 and a lower boss 30 integral therewith above and below member 16, each boss having a pair of spaced, internally threaded holes 32 for receiving screws which releasably connect the bracket 27 to body 12.

Nozzle body 12 has a generally cylindrical bore 33 therethrough which extends from the front face 14 of front plate 13 to the rear face 35 at the rear end of the rear portion 34 of member 16. Rear portion 34 is externally threaded so that a water conduit can be coupled to member 16 for delivering water to bore 33.

A flow control valve member 36 which is generally circular in shape is mounted in bore 33 for controlling the flow of water through the bore and outwardly of the front, open end 33*a* of bore 33. Front end 33*a* defines a water outlet for nozzle 10 and the rear open end of member 16 defines a water inlet.

Valve member 36 can be mounted in any suitable manner in nozzle body 12. For purposes of illustration, valve member 36 has a conical front surface 38 (FIG. 3) which is adapted to be moved toward and away from a conical rear surface 40 of a web 42 having a central hole 44 therethrough for receiving a stem 46 coupling member 36 with an externally threaded ring 48 having a forward projection 50 thereon. The projection 50 has the shape as shown in FIG. *3a*, and ring 48 is threadably coupled to body 12 near front, open end 33*a*. By manually rotating the ring 48 by turning projection 50, valve member 36 can be caused to move toward and away from web 42. Hole 44 in web 42 is large enough to allow a flow of water therethrough even though stem 46 is in the hole. However, the volume rate of flow of water through bore 33 is controlled by the position of valve member 36 with respect to web 42.

Nozzle body 12 has a secondary bore 52 formed in an upper boss 54 on nozzle body 12. Bore 52 is essentially parallel with bore 33 and has a check valve 56 therein. Several embodiments of the check valve are shown in FIGS. 6, *6a* and *6b*. The check valve is held in place by a threaded retainer 58 (FIG. 3), the retainer having a central hole 60 therethrough. Check valve 56 is adapted to allow fluid flow through bore 52 from left to right when viewing FIG. 3; however, the check valve prevents reverse flow i.e., fluid flow from right to left when viewing FIG. 3.

The check valve operates to allow air to flow into and through a third bore 62 (FIGS. 3 and 4) which extends transversely of and interconnects bores 34 and 52. An extension 64 of bore 52 is shown in FIG. 4 to the right of bore 62 when viewing FIG. 4.

Bore 62 allows air from secondary bore 52 to enter the main bore 33 near front end 33*a* when water flows through bore 33 in the direction of arrow 66 (FIG. 3). An aspirating effect at the inner end of bore 62 is produced by the flow of water through bore 33 to cause air to flow through retainer 58, check valve 56 and bore 62 and into bore 33. Thus, the air flowing into bore 33 aerates the water.

An air flow control member 66 is rotatably mounted in bore extension 64 and has an outer projection 68 to permit member 66 to be manually rotated. Member 66 has an inner part 70 provided with an inclined, flat surface 72 which is vertically aligned with bore 62 and adjustably controls the flow of air through bore 62 from bore 52. By changing the position of inclined surface 72 relative to bore 62, the volume rate of flow of air through bore 62 can be changed.

Bore 62 has an upper extension 62*a* (FIG. 4) which extends downwardly from the upper surface of upper boss 54. The open top of bore extension 62*a* is covered by a cap 72 (FIG. 3) having a leg 74 which extends into an annular recess 76 in flow control member 66, thereby holding the member in place yet allowing the member to be rotated relative to nozzle body 12.

In use, nozzle 10 is mounted on wall 22 of tub 24 in the manner shown in FIG. 3. The outer or rear part of body 12 is connected to a water conduit so that water can flow into and through valve body 12 and issue through the front, open end 33*a* into the tub. Control of the volume rate of flow of the water is achieved by manually adjusting the position of member 36 relative to web 42 (FIG. 3).

As water flows through bore 33 into the tub, it causes a suction force to occur at the inner end of bore 62. This causes air to flow into hole 60 of retainer 58, through the check valve 56, past part 70 of flow control member 66, into and through bore 62, and into the water flow. In this way, the water is aerated. Control of the volume rate of air flow is achieved by manipulating member 66 so that part 70 thereof allows a desired volume of air to flow into bore 62.

In one embodiment of check valve 56, the check valve has a tubular body 80 provided with a web 82 which shiftably mounts a shaft 84 having a valve member 86 which engages the conical side face 88 of web 82 to block off the air flow through the web. A retainer 90 is at the opposite end of shaft 84, and a coil spring 92 is under compression between retainer 90 and web 82. Thus, valve member 86 is biased to the left when viewing FIG. *6a* and toward a position in sealing relationship to conical web side face 88. When water flows through valve body 12, valve 86 is unseated by movement to the right when viewing FIG. *6a* due to a suction force against the bias force of spring 92. When the water flow ceases or if flow control member 66 is rotated to reduce the volume rate of air flow, the spring moves the valve 86 toward web side face 88.

A modification of the embodiment of the check valve in FIG. *6a* is shown in FIG. *6b*. A Welsh plug 94 having a central hole therethrough is used to cover the outer open end of body 80. Welsh plug 94 is forced into this open end and caused to expand so as to become locked in place in body 80.

In another embodiment of the check valve, boss 54 has an internal shoulder 54*a* (FIG. *6c*) and a coil spring 96 biases a ball-shaped element 98 into closing relationship with the central hole 60 of retainer 58. The ball unseats and allows air flow through bore 52 when a suction forces is created in bore 52 due to water flow through main bore 33 of nozzle body 12.

What is claimed is:

1. A fluid nozzle for a water tub comprising: a unitary nozzle body having means defining a main bore therethrough, said nozzle body adapted to receive a flow of water through the main bore; means carried by the main bore defining means and within the main bore for adjustably controlling the volume rate of flow of water therethrough, there being means coupled with the control means, independent of said main bore defining means, and accessible at the outlet end of the main bore for adjusting said control means, said nozzle body having a secondary bore adjacent to the main bore; a spring-biased check valve in the secondary bore for permitting a flow of air in one direction therethrough, said body having a third bore placing the secondary bore in fluid communication with the main bore near the outlet end thereof, the third bore having one end in fluid communication with the main bore at the outer periphery of the main bore; means coupled with said nozzle body for adjusting the volume rate of flow of air through the third bore, whereby air can flow past the check valve and into the main bore to aerate the water flowing therethrough.

2. A nozzle as set forth in claim 1, wherein said adjusting means is at the junction of the secondary bore and the third bore.

3. A nozzle as set forth in claim 1, wherein the secondary bore has a longitudinal extension, said adjusting means including a flow control member rotatably mounted in said extension of the second bore, at the junction of the secondary and third bores, and means for releasably holding the flow control member in place while permitting roration of the member relative to the body.

4. A nozzle as set forth in claim 1, wherein said control means comprises a ring threadably mounted in the body near the outlet end of said main bore, means in the main bore defining means for defining a valve seat, and a valve member coupled with the ring and moveable longitudinally of the main bore toward and away from the valve seat as a function of the rotation of the ring.

5. A nozzle as set forth in claim 4, wherein said valve member has a stem, said valve seat defining means including a web in the main bore, the web having a central hole therethrough, the stem extending through and spaced from the central hole, the web having a surface complemental to one face of the valve member, whereby the valve member can engage said surface of the valve seat and block the water flow through the main bore.

6. A nozzle as set forth in claim 4, wherein the ring has a projection thereon to permit manual rotation of the ring relative to the nozzle body.

7. A nozzle as set forth in claim 1, wherein the check valve is removably mounted in the secondary bore, and including a tubular retainer releasably holding the check valve in the secondary bore.

8. A nozzle as set forth in claim 1, wherein the nozzle body has a front plate and a tubular member integral with the plate and extending rearwardly therefrom, the main bore being in the tubular member.

9. A nozzle as set forth in claim 8, wherein is included a boss integral with the tubular member at the top thereof, the secondary bore being in the boss.

* * * * *